US006712688B2

(12) United States Patent
McGinty et al.

(10) Patent No.: US 6,712,688 B2
(45) Date of Patent: Mar. 30, 2004

(54) COIN CHANGER

(75) Inventors: Joseph R. McGinty, Madison, AL (US); Steven M. Faes, Canisteo, NY (US)

(73) Assignee: Qvex, Inc., Madison, AL (US)

( * ) Notice: Subject to any disclaimer, the term of this patent is extended or adjusted under 35 U.S.C. 154(b) by 0 days.

(21) Appl. No.: 09/849,918

(22) Filed: May 4, 2001

(65) Prior Publication Data

US 2002/0002423 A1 Jan. 3, 2002

Related U.S. Application Data

(60) Provisional application No. 60/202,021, filed on May 4, 2000.

(51) Int. Cl.[7] ..... G07D 1/00

(52) U.S. Cl. ..... 453/57; 453/49; 194/215; 194/302; 232/60; 221/75; 221/113; 221/119

(58) Field of Search ..... 221/277, 75, 113, 221/119, 120, 121, 122; 414/331.02; 453/49, 57, 12; 232/60

(56) References Cited

U.S. PATENT DOCUMENTS

| | | | | | |
|---|---|---|---|---|---|
| 322,236 | A | * | 7/1885 | Zaehringer | 232/60 |
| 751,081 | A | | 2/1904 | Larned | |
| 886,499 | A | | 5/1908 | Harrison | |
| 1,098,673 | A | | 6/1914 | Lyng | |
| 1,360,677 | A | | 11/1920 | Perry | |
| 1,625,979 | A | * | 4/1927 | Brinkerhoff | 453/49 |
| 2,121,971 | A | | 6/1938 | Landreth | |
| 2,952,348 | A | | 9/1960 | Buchholz et al. | |
| 3,036,732 | A | * | 5/1962 | Schaef | 221/113 |
| 3,177,290 | A | | 4/1965 | Norling et al. | |
| 3,605,970 | A | * | 9/1971 | De Crepy | 194/346 |
| 3,699,259 | A | | 10/1972 | Main et al. | |
| 3,759,441 | A | | 9/1973 | Hamilton et al. | |
| 4,232,988 | A | * | 11/1980 | Kochanneck | 414/331.02 |
| 4,458,802 | A | * | 7/1984 | Maciver et al. | 194/205 |
| 4,544,058 | A | * | 10/1985 | Choderker et al. | 194/325 |
| 4,553,694 | A | * | 11/1985 | Siegenthaler | 232/7 |
| 4,586,522 | A | * | 5/1986 | Taipale et al. | 453/10 |
| 4,630,624 | A | | 12/1986 | Turner | |
| 4,674,077 | A | * | 6/1987 | Yoshimoto et al. | 369/30.86 |
| 4,782,937 | A | | 11/1988 | Chen et al. | |
| 4,836,825 | A | | 6/1989 | Smeets et al. | |
| 5,007,518 | A | * | 4/1991 | Crooks et al. | 194/212 |
| 5,067,116 | A | * | 11/1991 | Kadrmas | 369/30.86 |
| 5,143,193 | A | * | 9/1992 | Geraci | 194/212 |
| 5,274,620 | A | * | 12/1993 | Sipos | 369/77.2 |
| 5,528,566 | A | * | 6/1996 | McGee et al. | 369/30.86 |
| 5,722,564 | A | * | 3/1998 | Tiraboschi | 221/131 |
| 5,924,543 | A | | 7/1999 | Faes et al. | |
| 5,992,602 | A | * | 11/1999 | Zwieg et al. | 194/317 |
| 6,019,247 | A | * | 2/2000 | Scott | 221/88 |
| 6,095,369 | A | * | 8/2000 | Jenkins et al. | 221/77 |
| 6,163,603 | A | | 12/2000 | McGinty et al. | |

FOREIGN PATENT DOCUMENTS

| | | |
|---|---|---|
| AU | 242397 | 5/1961 |
| CA | 796993 | 10/1968 |
| EP | 0 401 945 A1 | 12/1990 |

* cited by examiner

*Primary Examiner*—Donald P. Walsh
*Assistant Examiner*—Jeffery A Shapiro
(74) *Attorney, Agent, or Firm*—Gardner Groff, P.C.

(57) ABSTRACT

A series of staggered, overlapping coin carousels with coin stalls that receive coins, drive motors that operate to rotate the carousels and position the coin stalls so that the coins can be transferred between the carousels, and coin transfer mechanisms with gates that operate to move the coins between the carousels. An electronic controller is programmed to keep track of the positions and values of the coins in the coin stalls, and to determine and operate the appropriate drive motors and transfer gates for transferring coins between the carousels and for returning change.

16 Claims, 13 Drawing Sheets

| COIN TRANSFER SHEME | | |
|---|---|---|
| FROM | TO | LIFTING GATE |
| WHEEL 6d | WHEEL 6b | 28c |
| WHEEL 6d | WHEEL 6a | 28b |
| WHEEL 6a | WHEEL 6d | 28e |
| WHEEL 6a | WHEEL 6c | 28d |
| WHEEL 6b | WHEEL 6d | 28f |
| WHEEL 6c | WHEEL 6a | 28a |

COIN CHANGER

CROSS REFERENCE TO RELATED APPLICATION

This application claims the priority benefit of U.S. Provisional Application Ser. No. 60/202,021 filed May 4, 2000, which is hereby incorporated by reference in its entirety.

FIELD OF THE INVENTION

The present invention relates generally to coin changer devices that receive and evaluate deposited money and return change in coins and, more particularly, to a coin changer device with a random access coin storage and dispensing mechanism that accepts and returns change for a large number of different types of coins.

BACKGROUND OF THE INVENTION

Coin changers are commonly used in vending machines for drinks, snack foods, cigarettes, stamps, and so forth, in ticket machines, in change machines used in arcades and other amusement venues, and so forth. Also, coin changers are often used in combination with bill changers that receive and evaluate paper currency.

In the known prior art, coin changers typically include a mechanical or electronic coin sorter for evaluating the type of coin that has been deposited by a user. The evaluated and sorted coin is then routed and placed in a tube or stack of like coins. Such prior art coin changers are generally limited to having three or four tubes of specific denominations. For example, in the United States such a coin changer might have tubes containing stacks of nickels, dimes, quarters and halves or whole dollar coins.

One drawback to such coin changers is that they are typically each limited to a single currency. Accordingly, different versions of the coin changers are required for different countries owing to the difference in sizes of the various denominations from one country to the next. For example, at a border between two countries, such a coin changer would typically be set up to accept the coins of one country, but not the other.

Accordingly, it can be seen that a need yet remains for a coin changer apparatus which is flexible and adaptable enough to accept large numbers of different types of denominations and even different currencies at the same time, while still being able to make change effectively. It is to the provision of such a coin changer apparatus that the present invention is primarily directed.

SUMMARY OF THE INVENTION

Briefly described, in a first preferred form the present invention comprises a coin changer apparatus having a random access coin storage and dispensing device. The random access coin storage and dispensing device includes a plurality of individual coin stalls, each of which is adapted for containing one or more coins of variable size and denomination. An electronic controller is provided for noting how much coin value is stored in each of the individual coin stalls and for, when change is to be made, selecting which stalls are to be emptied in order to dispense the selected amount of change.

Preferably, the random access coin storage and dispensing device comprises one or more carousels having radially arranged coin stalls. Most preferably, a plurality of these carousels are arranged in a staggered, overlapping arrangement, so that coins can be passed from one carousel to the next. The coin stalls are sized to receive one or more coins of any denomination in current or likely future use in any country. Also, the random access coin storage and dispensing device includes drives for rotating the carousels to position the desired coin stalls for coin transfer, and coin transfer mechanisms with transfer gates to move to the coins from one stall to another.

This arrangement allows coins of various sizes and denomination to be placed randomly in storage, while noting the denomination and type of coin in each coin stall for later retrieval. Thus, the coin changer to be used at borders between countries and to accept denominations from more than one country. This also allows for a large variety in the size of the various coins to be accepted. In the prior art, typically the tubes are designed to handle only a specific diameter of coin, while the individual coin stalls used in the random access coin storage and dispensing device of the present invention allow for a virtually limitless number of individual coin sizes, limited only by the maximum size of a coin that can fit in the coin stall.

Advantageously, the present invention does not require a different coin changer to be manufactured for each individual country's unique denomination set. Moreover, should a country or locale change their coin set, as is happening in Europe with the introduction of Euro coinage, the present invention allows for new coin sets to be accepted without requiring new hardware configurations.

BRIEF DESCRIPTION OF THE DRAWING FIGURES

Figure 10A:
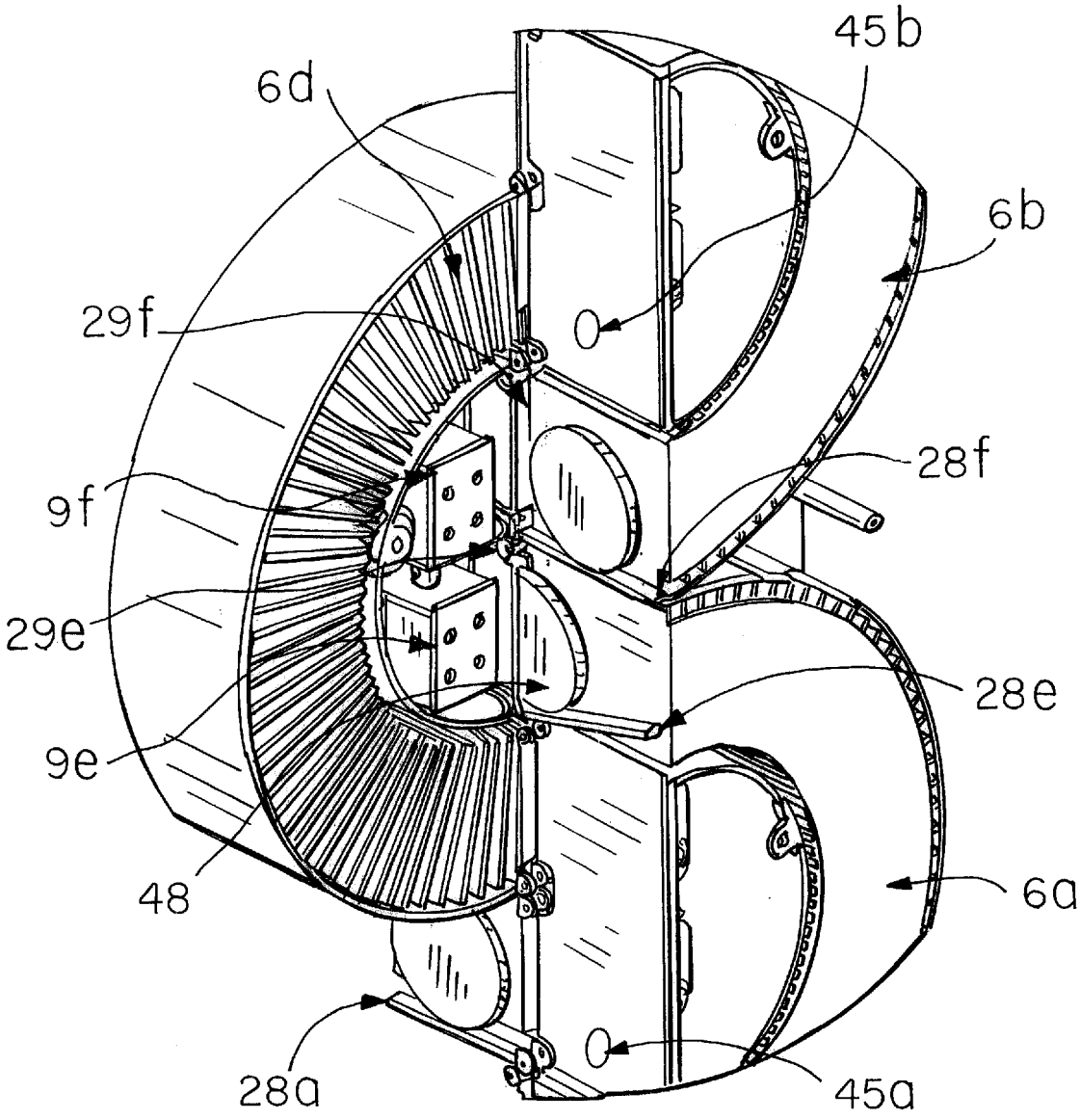

FIG. 10*a* is a perspective partial sectional view of a portion of three of the segmented coin carousels and the associated coin transfer mechanisms in operation.

Figures 10B, 10C:
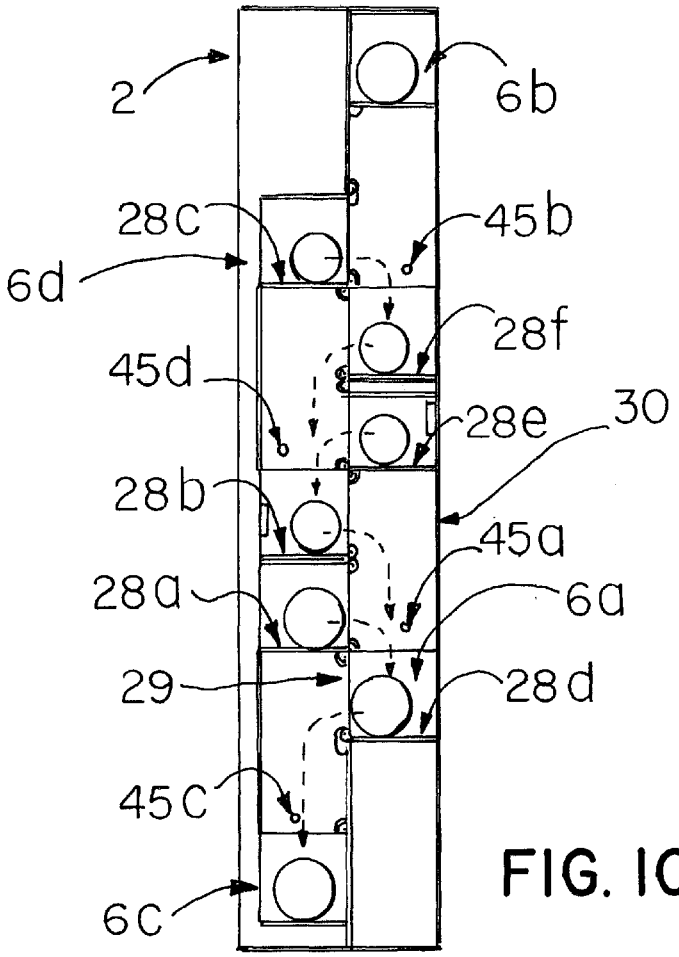

FIG. 10*b* is a cross section elevation view of the coin changer showing the operation of the coin changer according to a coin transfer scheme permitting coins to be transferred between any of the carousels.

FIG. 10*c* is a table of the coin transfer scheme, listing the appropriate transfer gate to be operated to transfer coins between the carousels.

Figure 11:
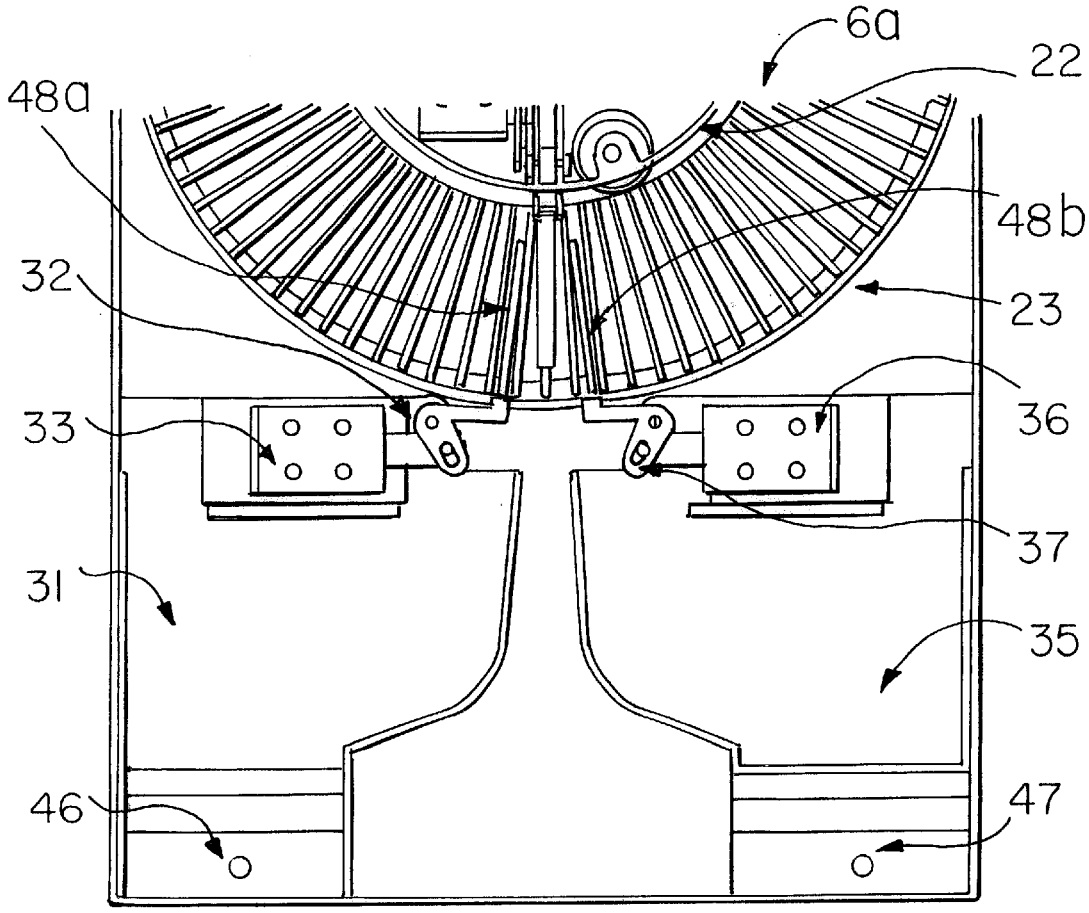

FIG. 11 is a cross section elevation view of a coin change delivery mechanism and a cash box mechanism of the coin changer, shown with gates in the rest or "off" position.

Figure 12:
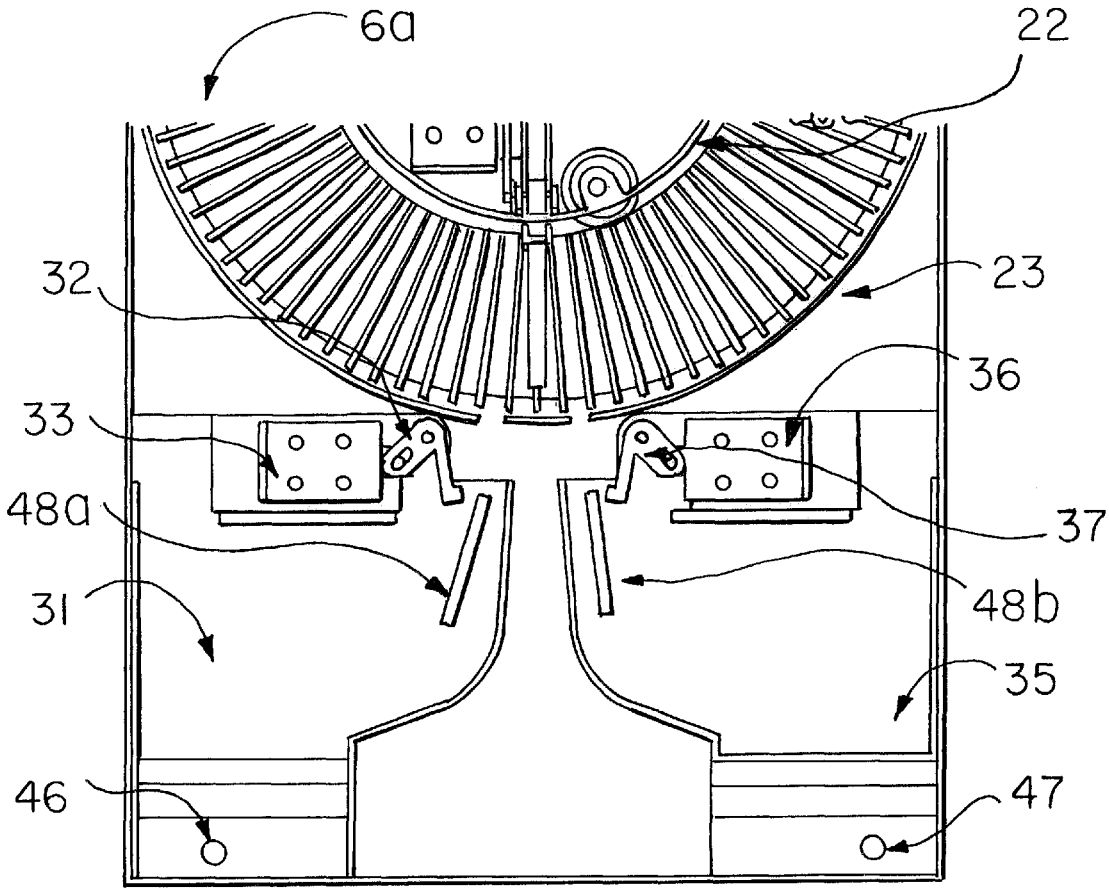

FIG. 12 is a cross section elevation view of the coin change mechanism and the cash box delivery mechanism, shown the gates in the "on" position.

Figure 13:
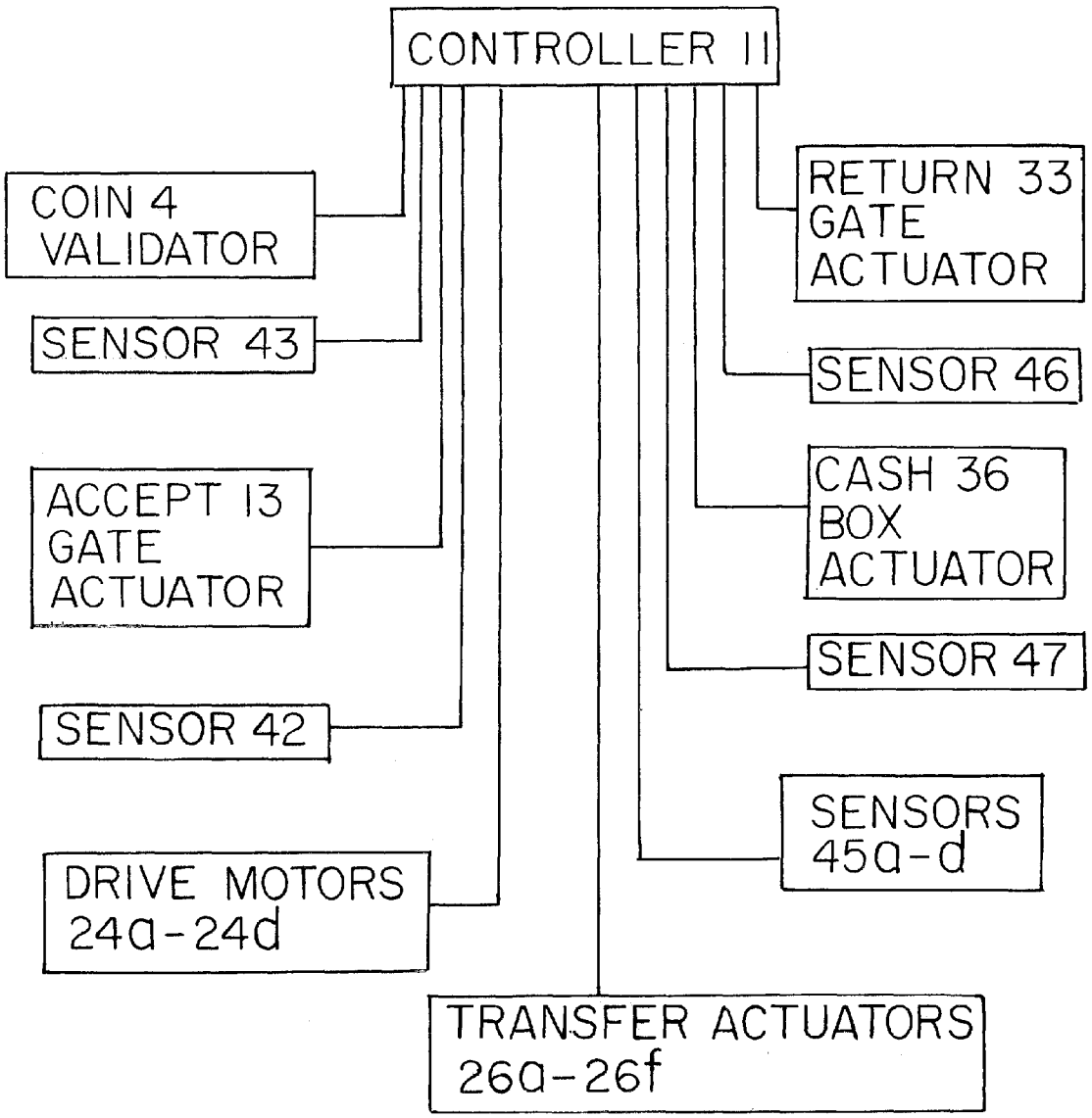

FIG. 13 is a schematic diagram of the control module and the electronic components connected to the control module.

Figure 14A:
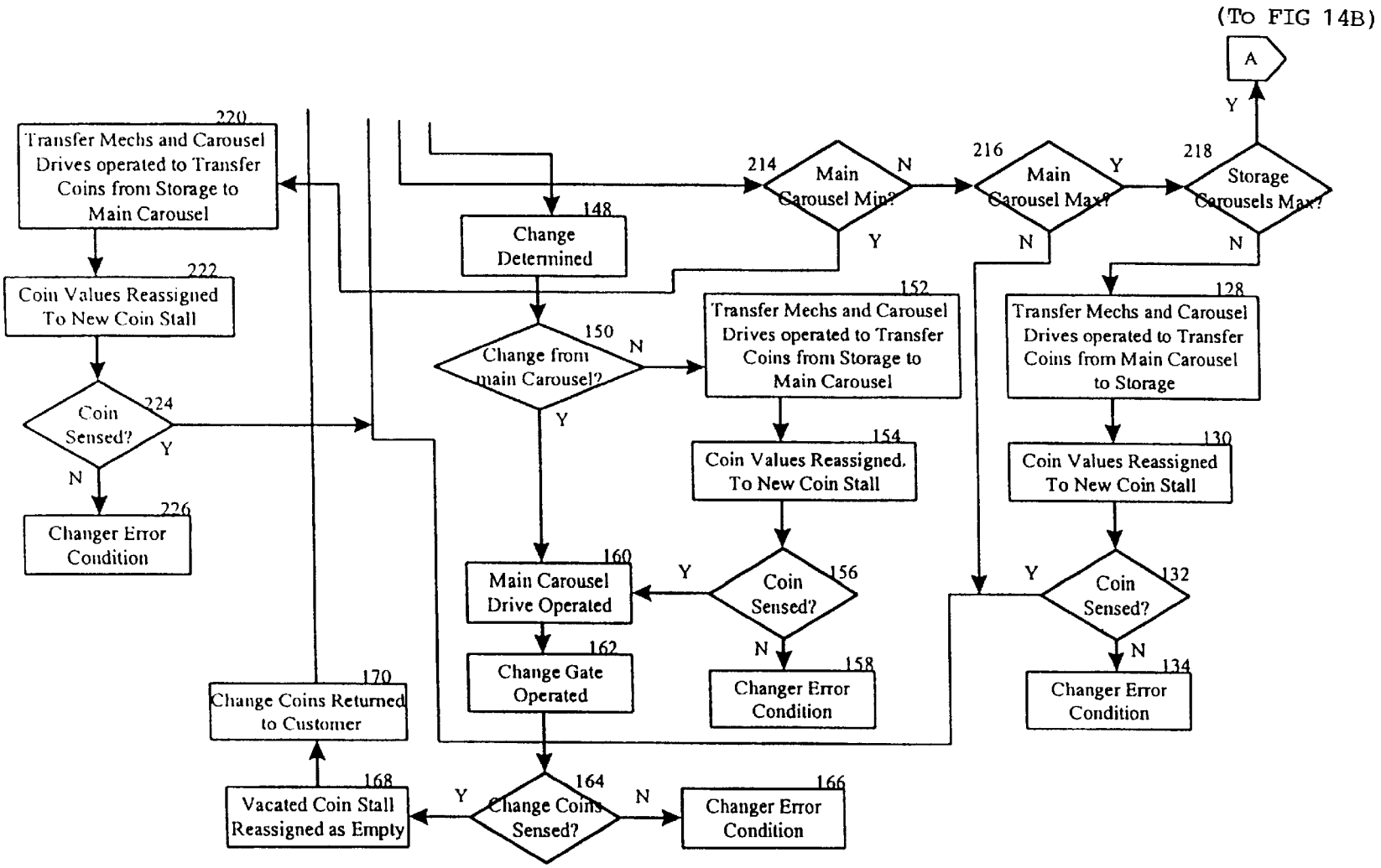
Figure 14A:
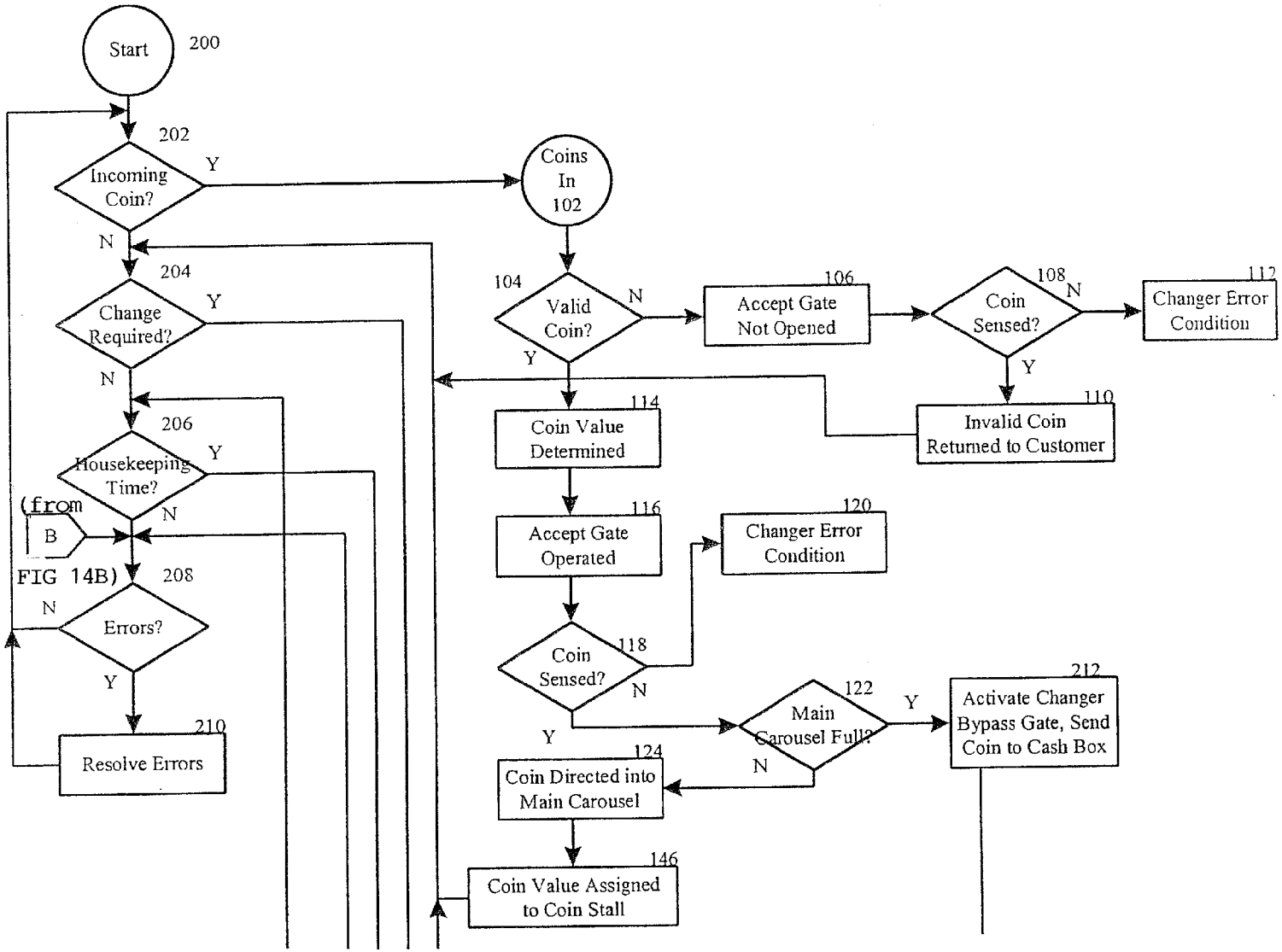
Figure 14B:
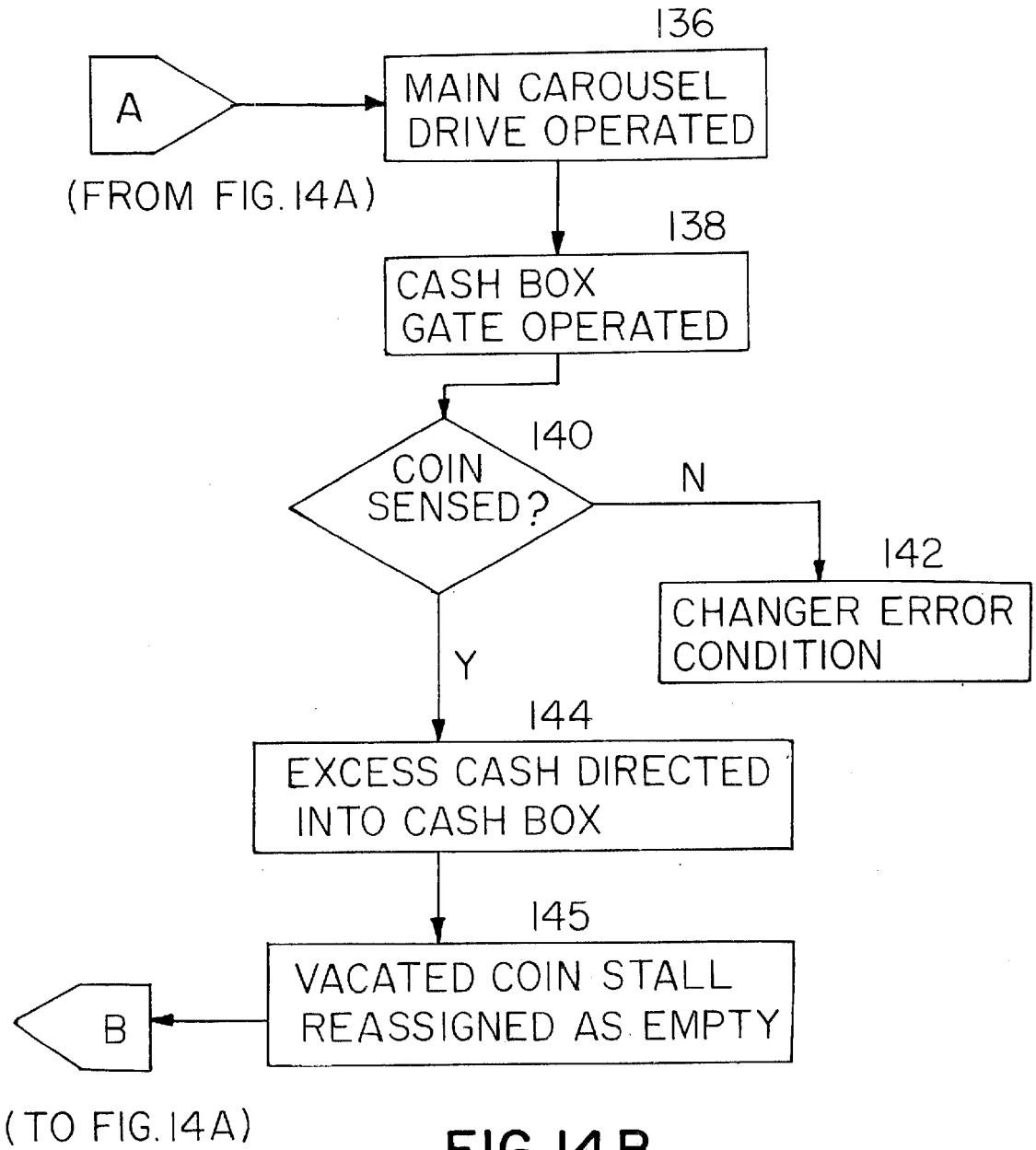

FIGS. 14A and 14B are a flow diagram of an exemplary method of electronically controlling a coin changer.

DETAILED DESCRIPTION OF THE EXEMPLARY EMBODIMENT

Figure 1:
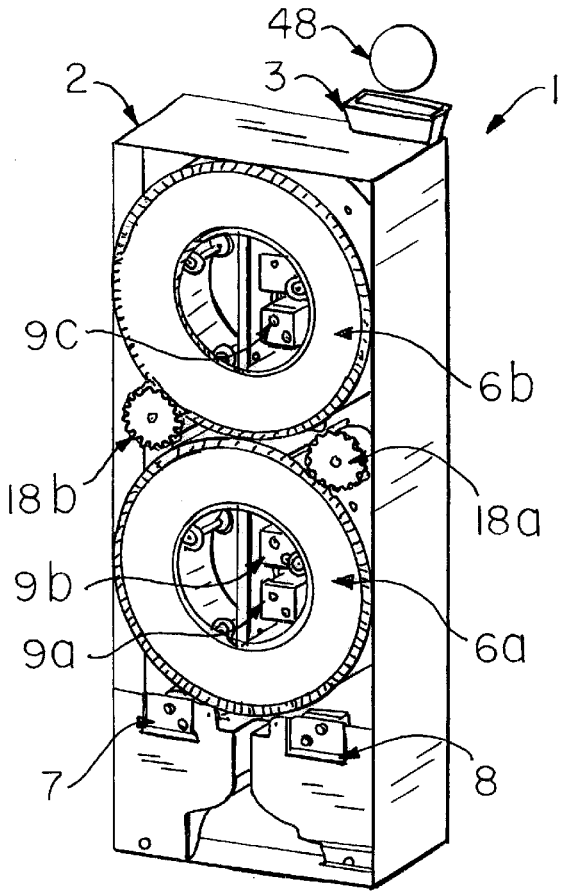
FIG. 1 is a perspective view of an exemplary coin changer mechanism of the present invention, showing the major components on a change giving and cash box side of the mechanism.
Figure 2:
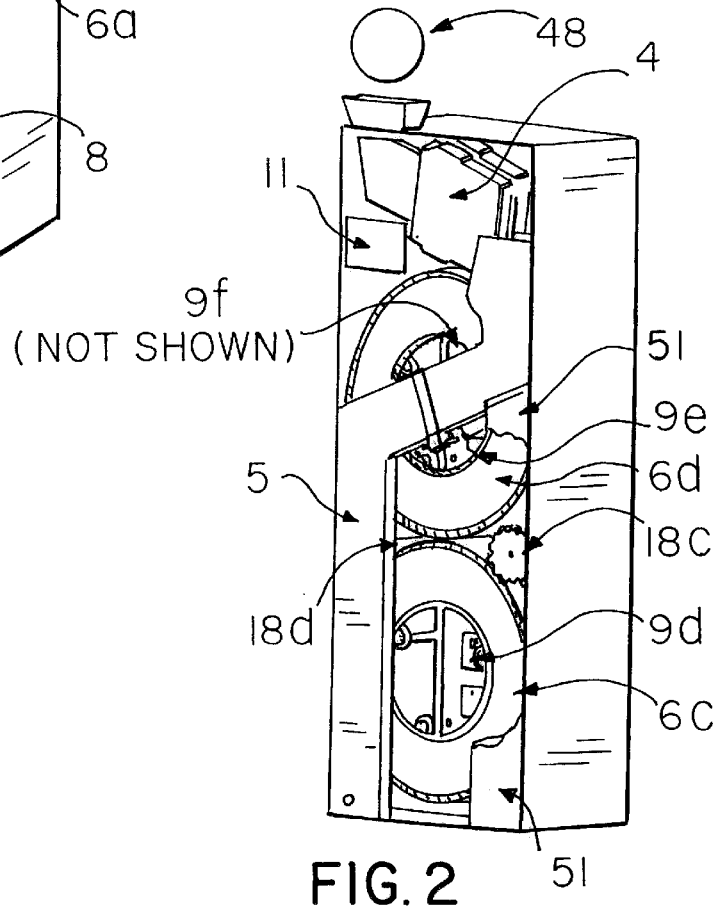
FIG. 2 is a perspective view of the coin changer showing the major components on a coin validator and coin acceptor/rejector side of the coin changer.

Referring to the drawing figures, wherein like reference numerals represent like parts throughout the several views, FIGS. 1 and 2 show an exemplary coin change apparatus 1 (hereafter referred to as the "coin changer"). The coin changer 1 includes a main frame 2, a coin validator 4, a coin accept/reject mechanism 5, a changer bypass mechanism, a random access coin storage and dispensing mechanism, a coin change delivery mechanism 7, and a cash box delivery mechanism 8. The random access coin storage and dispensing mechanism includes a series of segmented coin carousels 6*a*–6*d*, a series of coin transfer mechanisms 9*a*–9*f* (see FIG. 10*a* for coin transfer mechanism 9*f*), and a control module 11. The main frame 2 can be made of a metal or other material and is mounted within or external to the pay machine in which it operates. The control module 11 is electrically connected to and receives power from the power source that the associated pay machine is connected to.

The main frame 2 has a coin input chute 3 that receives a coin 48 into the coin changer 1 and directs it into the coin validator 4 for processing. The coin validator 4 is connected electrically to the control module 11. The coin validator 4 determines if the coin 48 is a valid coin and determines the value of the coin, and can be provided by a conventional coin validating mechanism as is known in the art. The coin 48 then exits the coin validator 4 and enters the coin accept/reject mechanism 5.

Figure 3:
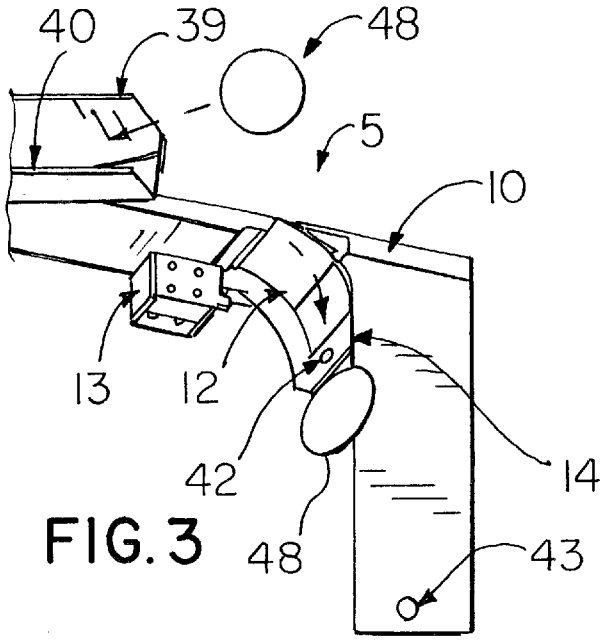
FIG. 3 is a perspective view of a coin acceptor/rejector of the coin changer, shown in the coin accept position.
Figure 4:
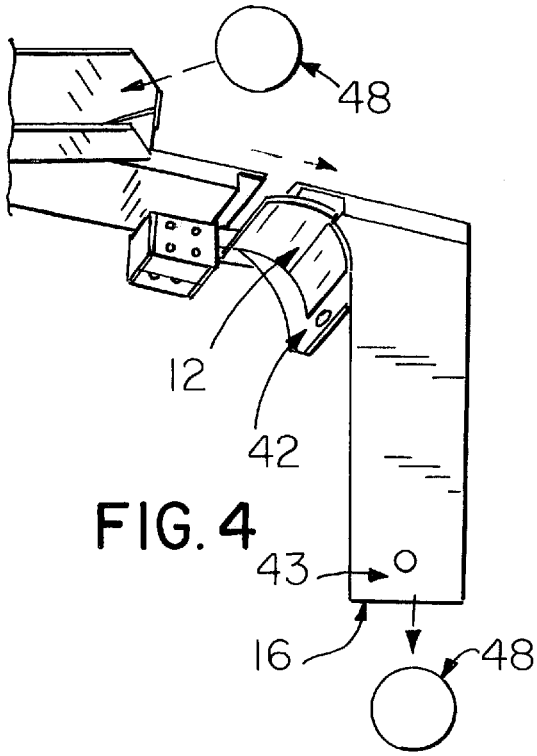
FIG. 4 is a perspective view of the coin acceptor/rejector shown in the coin reject position.
Figure 5:
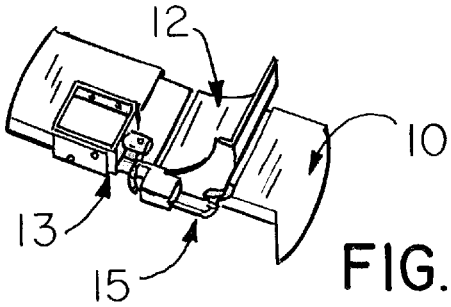
FIG. 5 is a perspective view of the coin acceptor/rejector showing a gate in the accept position.

Referring to FIGS. 3–5, the accept/reject mechanism 5 consists of a chute 10, an accept gate 12, a coin guide surface 14, an actuator such as a solenoid 13, and a linkage 15 that connects the solenoid 13 to the gate 12. The chute 10 has a pair of input walls 39 and 40 that effectively guide the coin 48 into the chute 10 after it exits the coin validator 4. The coin 48 travels around a bend in the chute 10 and approaches the gate 12. The gate 12 pivots or otherwise moves between a "coin reject" position and a "coin accept" position. The coin reject position is the default or "power off" position of the coin changer 1, so coins will travel through the chute 10 and pass by the gate 12 unless the gate is operated. Of course, the changer can be alternatively provided with the accept position as the default. The chute 10, gate 12, and linkage 15 can be made of a metal, plastic, or other material. Although the actuator is shown as solenoid 13, alternatively, the actuator can be provided by a servomotor or other linear or rotary actuator, as may be desired.

In FIG. 4 the gate 12 of the accept/reject mechanism 5 is shown in the "coin reject" position. If the coin validator 4 detects an invalid coin, the control module does not send a signal to operate the accept gate 12, so the coin 48 rolls (or slides) past the gate 12. The coin 48 continues rolling until it exits the reject opening 16 and is returned to the customer by a change coin receptacle as is known in the art. As the coin exits the reject opening 16, a sensor 43 that is connected to the control module 11 detects it. If the coin 48 does not pass the sensor 43, the control module 11 gives an error signal and the coin changer 1 takes appropriate action, for example, it may become inactive.

In FIGS. 3 and 5 the accept/reject mechanism 5 is shown in the "coin accept" position. If the coin validator 4 detects a valid coin, then it sends an electrical signal to the control module verifying the coin denomination (i.e., the coin value). The electronic control module 11 then sends an electrical current to the solenoid 13 causing it to operate. The solenoid 13 pulls on (or alternatively pushes, rotates, or otherwise moves) the linkage 15 causing the gate 12 to rotate to the position as shown in FIGS. 3 and 5. As the coin rolls through the chute 10, it makes contact with the guide surface 14 and is directed away from the chute 10.

Figure 6:
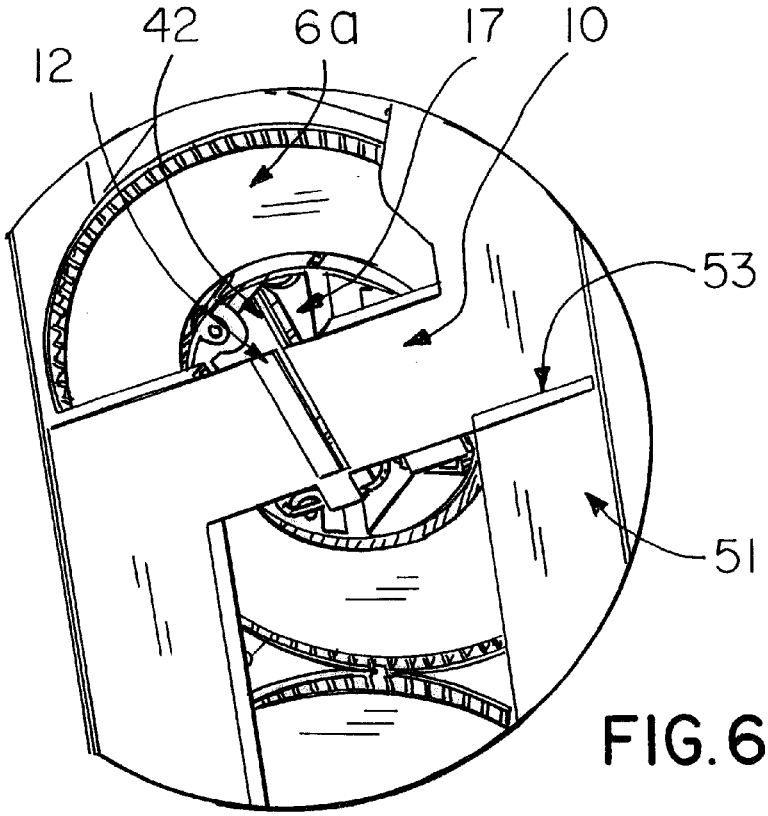
FIG. 6 is a perspective detail view of a portion of the coin acceptor/rejector showing an input slot to a segmented carousel, as shown on the validator and acceptor/rejector side of FIG. 2.
Figure 6A:
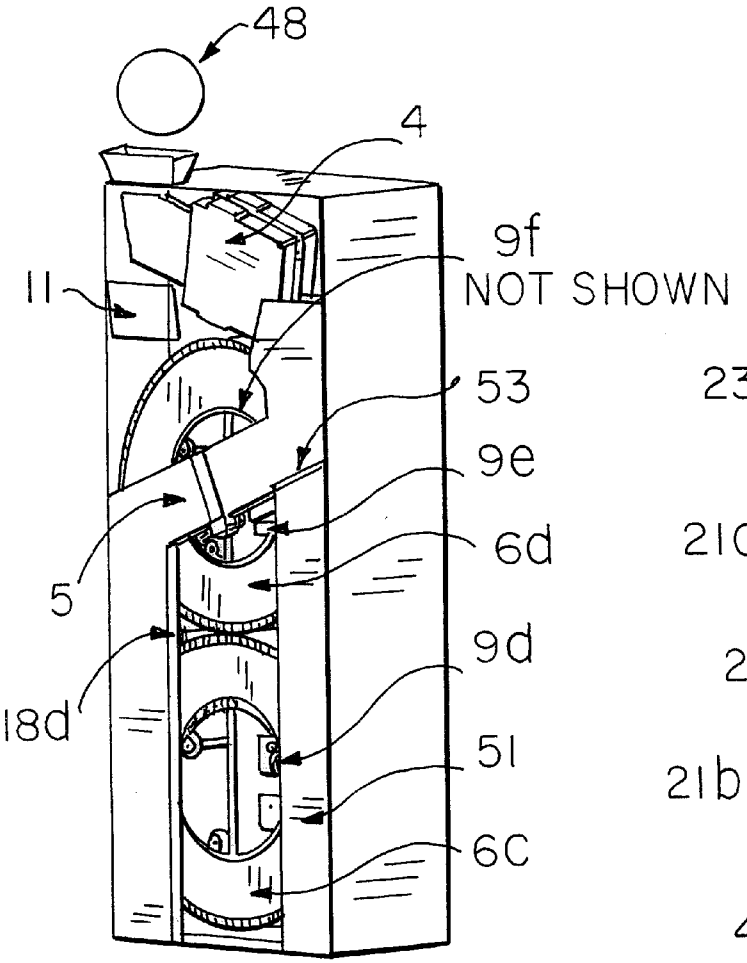
FIG. 6A is a perspective view of the changer bypass mechanism positioned between the coin validator and the cash box.

Referring to FIGS. 6 and 6*a*, if the carousels are full or if the coin deposited is a silver dollar or other coin not normally given as return change, then the coin can be routed directly to the cash box by the changer bypass mechanism. The bypass mechanism includes a bypass chute 51 the is positioned between the coin validator 4 and the cash box, and a bypass gate 53 with an actuator such as a solenoid coupled thereto, directly or by a linkage. In this manner, when the coin validator detects a certain coin, it can send the coin to the cash box without going through the carousels.

Figure 7:
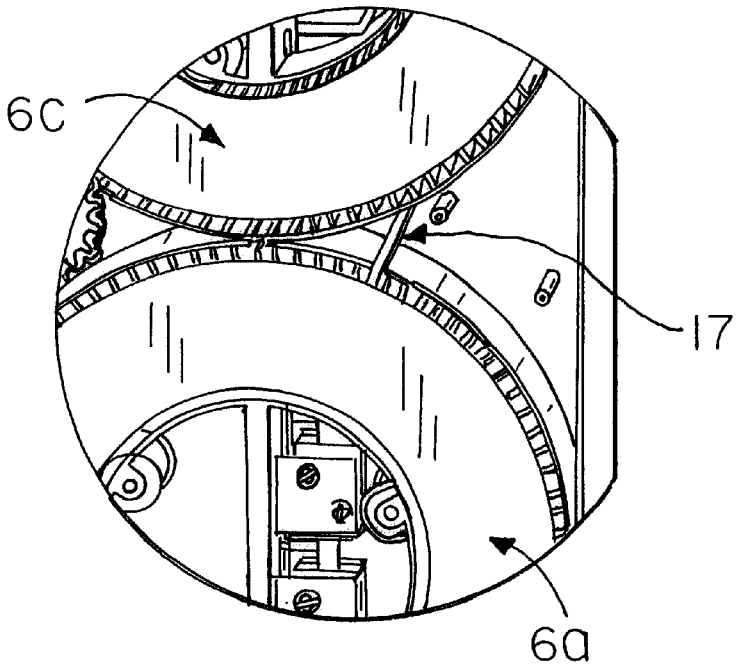
FIG. 7 is a perspective detail view of the input slot, as shown on the change/cash box side of FIG. 1.

Referring to FIGS. 6 and 7, the valid coin is then guided by the guide surface towards a carousel input slot 17. As the coin enters the slot 17, a sensor 42 detects it. If the coin 48 does not pass the sensor 42, an error signal is given by the control module 11 and the coin changer takes appropriate action. If the sensor 42 detects the coin 48, then the detected coin passes through the slot 17 and enters into the main carousel 6*a*.

Figure 8:
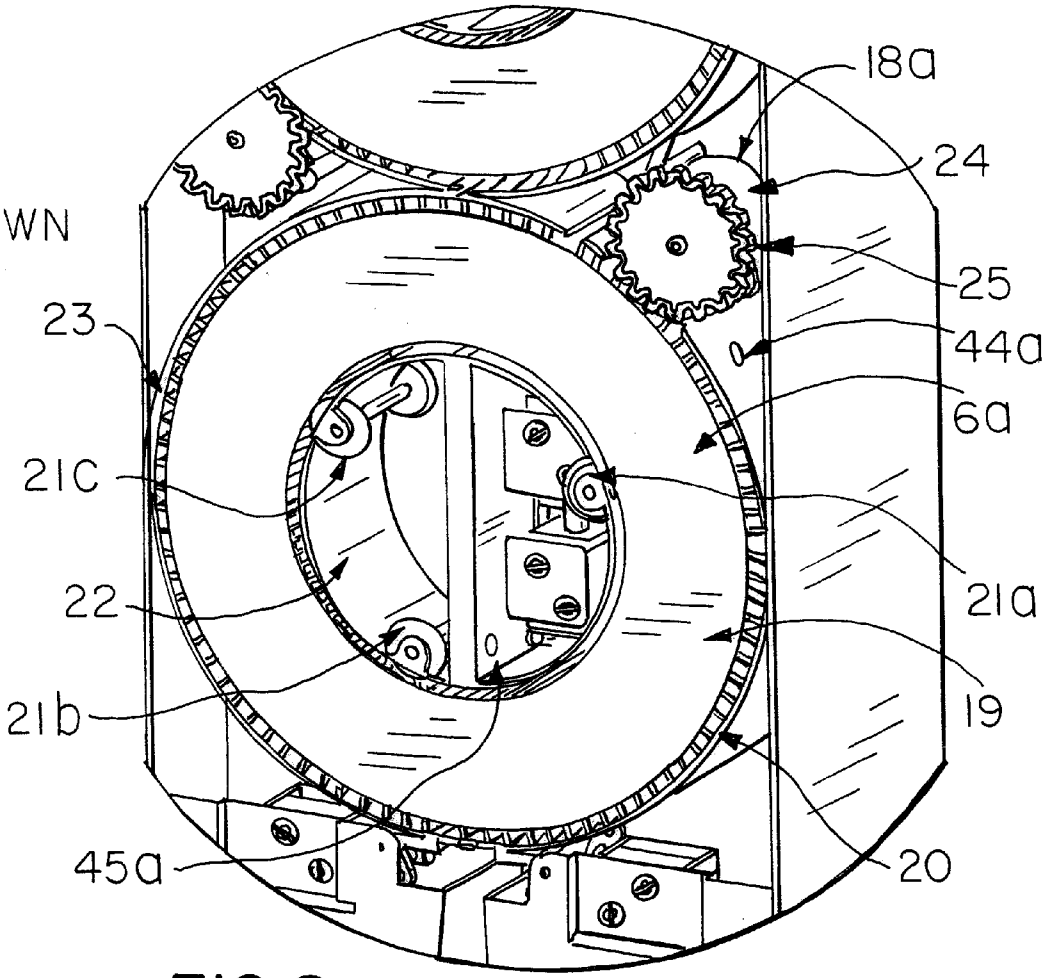
FIG. 8 is a perspective detail view of a segmented coin carousel and coin carousel drive system of the coin changer, as shown on the change/cash box side of FIG. 1.
Figure 9:
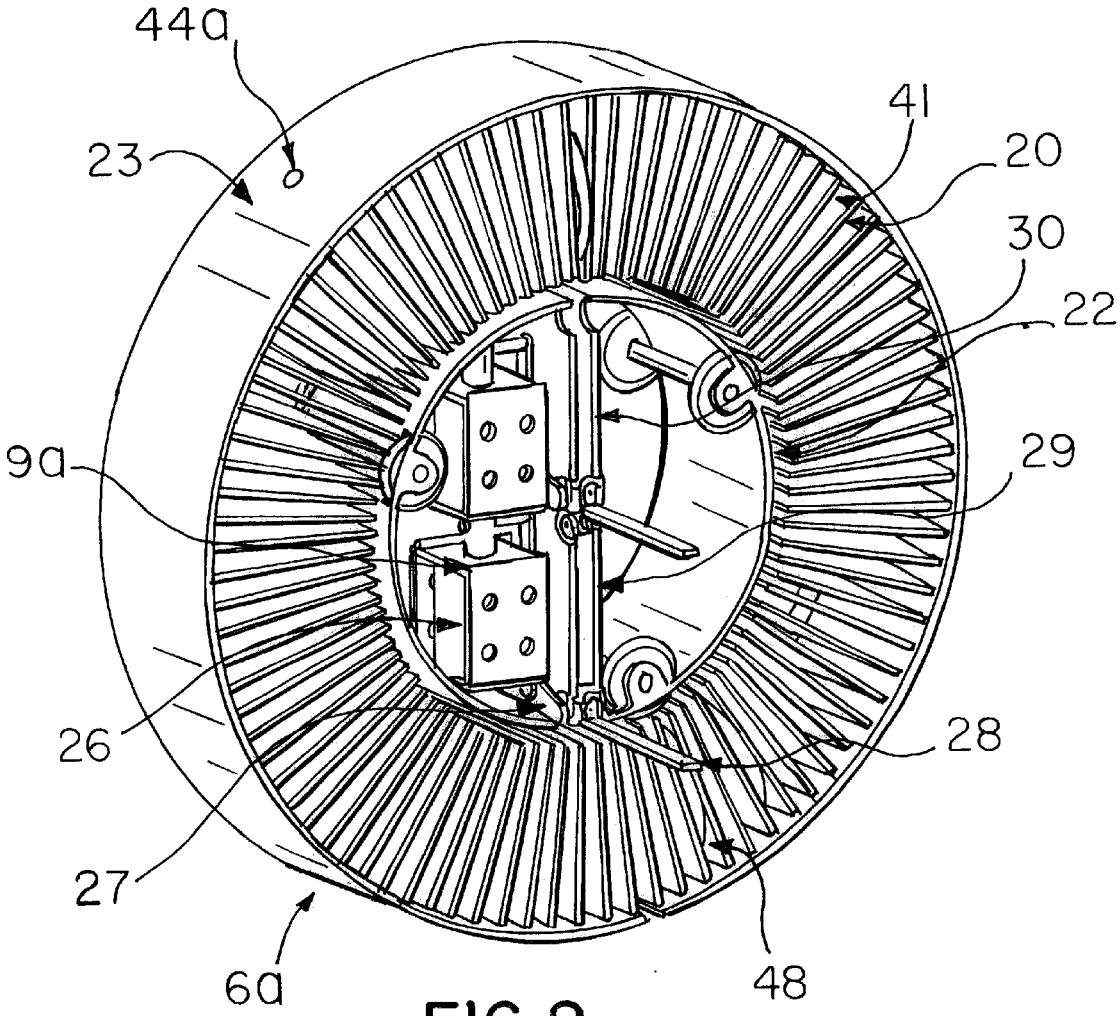
FIG. 9 is a perspective cross section view of the coin carousel and a coin transfer mechanism, shown from an inner side of the carousel.

Referring to FIGS. 8 and 9, the main carousel 6*a* is segmented into a series of coin stalls 41 that receive and store the coins separately from each other. The coin carousel 6*a* has a wheel 19, an inner circular wall 22, an outer circular wall 23, and a series of stall walls 20 that together define the coin stalls 41. The wheel 19, inner wall 22, outer wall 23, and walls 20 can be made of a metal, plastic, or other material. Also, the wheel 19, inner wall 22, outer wall 23, and walls 20 can be arranged to form generally radial coin stalls 41 that are sized and shaped to hold one or more coins of any currency in use. In this way, instead of the coins being stored in vertically arranged coin tubes sized for specific coins denominations, as is customary in the prior art, any conventional (present or likely future) coin (or a number of coins) can be stored in any of the coin stalls. Thus, the limitations on the number of different types of coins stored in the coin changer are effectively eliminated.

The walls 20 make contact with one or more rollers 21*a*–21*c* that suspend the carousel 6*a* and allow it to rotate freely about its center axis. Alternatively, the wails 20 or another portion of the carousel 6*a* can be supported by rotational bearings, wheels, or another structure. Also, a drive 18*a* has a motor 24 (for example, a bi-directional electric motor) and a drive gear 25 affixed to an output shaft of the drive motor 24. The drive gear 25 engages the walls 20 or another portion of the carousel, so that the carousel rotates upon rotation of the drive motor and gear. The drive motor 24 is connected electrically to and operated by electric signals from the control module 11.

As the coin 48 enters the main carousel 6*a* from the input slot 17, the control module 11 determines what position the coin 48 is to be stored in and sends an electrical current to the motor 24 causing it to rotate the gear 25. The gear 25 engages the walls 20 and causes the carousel 6*a* to rotate. The walls 20 then guide the coin(s) to a desired coin stall 41. A sensor 44*a* detects the "home" position of the carousel 6*a* and is connected to the control module 11. As the carousel 6*a* is rotated, the control module 11 keeps track of the current position of the coin 48 (or any coin stored within any carousel). A small amount of off-center axial motion can be generated by the rollers 21*a*–21*c* and the wall segments 20, which acts as a vibration that keep the coins form adhering to the sides of the coin stalls 41.

It will be understood that coin carousels 6*b*–6*d* and drives 18*b*–18*d* have a similar construction to main carousel 6*a* and drive 18*a,* respectively. Also, the carousels 6*a*–6*d* are configured in a staggered, overlapping arrangement, so that a desired coin stall of one carousel can be positioned above (or below) and adjacent to a desired coin stall of the adjacently staggered and overlapping carousel, with the open side of each of the carousels (the side where the coin stalls are open for receiving coins) facing each other. Alternatively, the carousels can be staggered and overlapped so that the coin stalls of adjacent carousels can generally aligned for coin transfer. In this manner, coins can be passed from one carousel to the next (as described below). Accordingly, the carousels can be configured with the main carousel 6*a* staggered and overlapping with one or more storage carousels 6*b*–6*d* (see FIG. 10*b*). It will be understood that any number of carousels can be provided, as desired for a given application. For example, for low use or frequently monitored coin changers, only the main carousel can be provided, or for other applications, only the main carousel and one storage carousel can be provided, and for still other applications, more than one storage carousel can be provided.

Referring to FIGS. 9 and 10*a*, coin transfer mechanism 9*a* is defined by an actuator such as a solenoid 26, a link 27 connected to the solenoid, a coin transfer (lifting) gate 28 connected to the link, and a coin blocking plate 29. It will be understood that coin transfer mechanisms 9*b*–9*f* have a similar construction, and include transfer gates 28*b*–28*f* (see FIG. 10*b*). The transfer gates 28*a*–28*f* and links can be made of metal, plastic, or another material, and the actuators can be provided by solenoids, servomotors, or other linear or rotary actuators. Also, the outer walls and the stall walls and/or the inner walls and the stall walls can be spaced apart to form circular channels into which the corresponding transfer gates 28*a*–28*f* extend, so that the carousels can rotate until the stationary, extended transfer gates align with the desired coin stall. Additionally, instead of the transfer gates 28*a*–28*f* being provided by pivotal lifting arms as shown, they can be provided by pivotal suspended arms, linear or rotary moving members, or other structures. The control module operates the drives to rotate the carousels so that coins are positioned on the appropriate transfer gate, as described above.

The coin transfer mechanisms 9*a*–9*f* are operable to move the coins 48 between the carousels 6*a*–6*d*, as desired. When the control module 11 determines where to move a coin (to deliver change, to store a coin for later use, or to deliver a coin to the cash box), the appropriate motor is energized, causing the corresponding carousel to rotate until the desired coin stall 41 is aligned with the desired transfer gate. Then the motor is then de-energized, and the corresponding solenoid is energized causing the corresponding linkage to move and pivot (or otherwise move) the corresponding transfer gate. The transfer gate raises (or otherwise moves) from a normal position (see gate 28*f* of FIG. 10*a*) to a transfer position (see gate 28*e* of FIG. 10*a*), thereby causing the coin 48 to begin to roll. The coin 48 hits the blocking gate 29 causing it to rotate, and then the coin enters a channel member 30 and is guided into the desired open stall 41 on the adjacent carousel. As the coin passes through the channel 30, it passes a detector 45*a*. The coin must clear the detector 45 for the coin changer 1 to remain in the normal operational mode.

FIGS. 10*b*–10*c* show a coin transfer scheme for operating the appropriate transfer gate to transfer coins between the carousels 6*a*–6*d*. Coins are deposited into and returned to the customer from the main carousel 6*a*. Also, coins can be transferred to storage carousels 6*b*–6*d* as desired. For example, coins can be transferred to the storage carousels 6*b*–6*d* when the main carousel 6*a* is full, to balance the weight of the coins amongst the carousels and/or within a particular carousel, to position more frequently returned coins closer to or in the main carousel, and/or for other reasons.

When the control module determines that the coins to be returned as change should be delivered directly from the main carousel 6*a,* then the control module operates the carousel 6*a* to rotate the desired coin stall to a coin return position for delivery to the customer. When, however, the control module determines that the coins to be returned should be delivered from one of the storage carousels 6*b*–6*d,* then the control module first operates the drives and transfer mechanisms to transfer the desired coinage to the main carousel 6*a*. For example, if the control module determines that the coins to be returned should be delivered from storage carousel 6*c,* then the control module operates the main carousel 6*a* and the storage carousel 6*c* to rotate the desired storage carousel coin stall to a position above and adjacent the desired coin stall of the main carousel, and operates transfer gate 28*a* to transfer the coin.

Similarly, if the control module determines that the main carousel 6*a* is sufficiently stocked with coins, or to balance the weight of the coins in the carousels, the control module causes the appropriate drives and corresponding transfer gates to be operated to transfer the desired coins from the main carousel 6*a* to the storage carousels 6*b*–6*d*. Furthermore, when the control module determines that the carousels 6*a*–6*d* are full of coins, then it causes the appropriate drives and corresponding transfer gates to be operated to transfer the excess coins to the main carousel 6*a* for delivery to the cash box delivery system. FIG. 10*c* identifies the appropriate transfer gates 28*a*–28*d* to be operated to accomplish these coin transfers.

Referring to FIGS. 11 and 12, the coin change delivery mechanism is defined by a chute 31, an actuator such as solenoid 33, and a gate 32, and the cash box delivery mechanism is defined by a chute 35, an actuator such as solenoid 36, and a gate 37. FIG. 11 shows coins 48*a* and 48*b* in coin stalls and positioned on gates 32 and 37, respectively, with the actuators de-energized and the gates in the closed position. FIG. 12 shows coins 48*a* and 48*b* in the chutes 31 and 35 of the coin change delivery mechanism and the cash box delivery mechanism, respectively, after the coins have fallen through slots in the main carousel 6*a,* with the actuators energized and the gates in the open position. While the actuators are shown as solenoids, alternatively they can be provided by servomotors or other linear or rotary actuators. Also, while the gates are shown as pivotal arms, alternatively, they can be provided by sliding or rotary members, or by other structures. Additionally, while the gates are shown as closed when the actuators are de-energized, alternatively, the actuators can be configured so that the gates are open when actuators are de-energized.

When the control module determines that change needs to be returned to the customer, and how much coin change is to be returned and how much deposited coinage (if any) is to be kept, it operates the carousel drives and coin transfer mechanisms to transfer the coins to the main carousel (as described above) and to position the desired coins on the return and/or cash box gates. The control module then operates the coin change delivery mechanism and, when needed, the cash box delivery mechanism.

For change to be returned, an electrical current is supplied to the return solenoid 33, causing the return gate 32 to pivot (or otherwise move). The coin 48*a* then falls through the return slot in the main carousel 6*a* and into the return chute 31. The coin 48*a* continues to move through the chute 31 until it exits the coin changer 1 and is delivered to the change coin receptacle for return to customer. As the coin exits the chute 31, a sensor 46 detects it. If the coin does not pass the sensor 46, an error signal is given by the control module 11 and the coin changer becomes inactive.

For change to be kept, an electrical current is supplied to the cash box solenoid 36, causing the cash box gate 37 to pivot (or otherwise move). The coin 48*b* then falls through the cash box slot in the main carousel 6*a* and into the cash box chute 35. The coin 48*b* continues to move through the chute 35 until it exits the coin changer 1 and is delivered to cash box (not shown). As the coin exits the chute 35, a sensor 47 detects it. If the coin does not pass the sensor 47, an error signal is given by the control module 11 and the coin changer takes appropriate action.

Referring to FIG. 13, and as generally described above, the control module is electrically connected to the coin validator 4, the accept gate actuator 13 and the associated coin accept sensor 42 and coin reject sensor 43, the drive motors 24*a*–24*d*, transfer actuators 26*a*–26*f*, and associated carousel sensors 45*a*–45*d*, the return gate actuator 33 and the associated sensor 46, and the cash box gate actuator 33 and the associated sensor 47. The control module 11 includes a conventional electronic controller with a microprocessor, programming, and a memory storage device. The values and positions of the coins in the carousels can be tracked in tables in a database or other component of the memory. Additionally, the control module can be connected (by wires or wirelessly) to external devices for downloading or transmitting information such as coin usage histories and current coin inventory, and/or for uploading or receiving information such as programming for using the coin changer with newly introduced coins.

FIGS. 14A and 14B show a process flow 100 of the electronic controller programming for controlling a coin changer of the type described above. At step 200 the controller starts to operate and executes a main loop comprised of steps 202, 204, 206, and 208, and returns to 202. At step 202, a coin is deposited into the coin changer and directed into the coin validator, and the controller moves to step 102. At step 104, the validator determines if the coin is valid. If the coin is not valid, then at step 106 the controller does not send a signal to the accept gate actuator, so the coin moves past the gate. If the coin is sensed in the reject chute at step 108, then it is returned to the customer at step 110. However, if the coin is not sensed in the reject chute at step 108, then at step 112 a signal is sent to the controller for eventual error handling.

If the coin is determined to be valid, then at step 114 the validator determines the value of the coin and sends a signal to the controller indicating the value. Also, at step 116 the controller sends a signal to the accept gate actuator to operate the accept and direct the coin toward the main carouse. If the coin is not sensed at step 118 after it passes the accept gate, then at step 120 a signal is sent to the controller for eventual error handling.

At step 122, the controller determines if the main carousel if full of coins. If the main carousel is not full, then the coin is directed into an open stall of the main carousel at step 124. At step 146, the controller assigns the coin value of the coin to its coin stall position in the main carousel, and stores the coin value and position in memory. If the main carousel is full at step 122, then at step 212 the controller activates the changer bypass gate and sends the coin directly to the cash box, then returns to the main loop at step 204.

At step 204, the controller determines if change has been requested by the host machine. If yes, then at step 148, the controller determines the amount of change to be returned, and at step 150, the controller determines if there are coin stall positions on the main carousel with coins that equal the return change amount.

If coins are needed from one or more of the storage carousels, then at step 152 the controller sends signals to the appropriate drive motors and transfer actuators (see FIG. 10*c*) to transfer the needed coins to the main carousel. At step 154, the controller reassigns the coin value of the transferred coin to its new position, and stores the coin value and position in memory. If the transferred coin is not sensed at step 156 being transferred to its new position, then at step 158 a signal is sent to the controller for eventual error handling.

At this point, the main carousel has the needed coins for providing the change. At step 160, the controller sends a signal to the main carousel drive motor to cause the main carousel to rotate to position the designated coin stalls at the return change slot. At step 162, the controller sends a signal to the return actuator to operate the return change gate and empty the designated coin stall. If the designated coin is not sensed at step 164 after it passes the return gate, then at step 166 a signal is send to the controller and the coin changer is deactivated. Assuming the designated coin was sensed, then at step 168 the controller reassigns the coin stall an empty status and stores this in memory, and at step 170 it is directed into the coin return receptacle where the customer may retrieve the coin. At this point the controller returns to the main loop at step 206.

The controller determines if conditions exist to check the status of the coin storage system (housekeeping functions) in step 206. If yes, step 214 determines if the main carousel has a predetermined number of each coin required for change. If it is at or below the minimum coin set needed, then at step 220 the controller sends signals to the appropriate drive motors and transfer actuators (see FIG. 10*c*) to transfer the needed coins to the main carousel. At step 222, the controller reassigns the coin value of the transferred coin to its new position, and stores the coin value and position in memory. If the transferred coin is not sensed at step 224 being transferred to its new position, then at step 226 a signal is sent to the controller for eventual error handling. Otherwise, the controller returns to the main loop at step 208.

If the main carousel is not at the minimum conditions at step 214, the controller determines if the main carousel has the maximum coins needed. In step 216, if not at the maximum, no action is taken and the controller returns to the main loop at step 208. If yes at step 216, the controller then determines if the storage carousels are also in a maximum condition in step 218. If the storage carousels are not full, then at step 128 the controller determines where there are available coin stalls in the storage carousels, and sends signals to the appropriate drive motors and transfer actuators (see FIG. 10*c*) to transfer stored coins from the main carousel to the storage carousels. At step 130, the controller reassigns the coin value of the transferred coin to its new position, and stores the coin value and position in memory. If the stored coin is not sensed at step 132 being transferred to its new position, then at step 134 a signal is sent to the controller for eventual error handling. Assuming the transferred coin was sensed, the controller returns to the main loop at step 208.

If the storage carousels are determined to be full at step 126, then at step 136 the controller designates one or more coin stalls to be emptied, and sends signals to the main carousel drive motor to rotate the main carousel to position the designated coin at the cash box delivery slot. At step 138, the controller sends a signal to the cash box actuator to operate the cash box gate and empty the designated stall. If the designated coin is not sensed at step 140 after it passes the cash box gate, then at step 142 a signal is sent to the controller for eventual error handling. Assuming the designated coin was sensed, then at step 144 it is directed into the cash box for storage, and the controller reassigns the coin stall an empty status and stores this in memory at step 145. The controller then returns to the main loop at step 208.

At step 208, if error flags are sensed, the controller will execute appropriate error recovery programs in step 210 to attempt to clear the error. For example, the controller may drive a carousel in alternate directions rapidly to shake a coin loose and recover from the error condition.

It will be understood that the controller can be provided with variations to the above described control process. For example, the sensors can be positioned at various locations, come of the sensors can be eliminated, additional sensors can be included, the sensors can be configured to communicate with the controller by sending a "not sensed signal" instead of no signal at all, and so forth. Also, the accept gate actuator, transfer gate actuators, return change actuator, and cash box actuator can be configured with to be in the opposite position from that described when de-energized. Additionally, the control method can be simplified by eliminating some of the steps described, and additional steps can be added for specific applications.

Accordingly, the coin changer and controller therefor allow for receiving, evaluating, and randomly storing many different types and sizes of coins, without having to reconfigure the coin changer hardware. This arrangement allows the coin changer to be used at borders between countries and to accept denominations from more than one country. Furthermore, because the coin changer can hold any denomination coin randomly in any of the coin stalls, it can be used even if it experiences a coin jam, whereas for conventional tube-type coin changers, a coin jam in a tube will cause the changer to be unusable. Also, the coin changer does not have to be monitored as frequently as the prior art tube-type coin changers.

In the exemplary embodiments described above and the following claims, the words "a," "an," and "one" are not intended to mean only "one" but can also mean any number greater than one, and terms used in the plural tense are not intended to mean only "more than one" but can also mean "only one." Also, the method of the present invention can be implemented using various other coin changer apparatus and in various other sequences than those described herein.

Having thus described the preferred forms of the present invention, those skilled in the art will additionally recognize that these are exemplary only, and that various other alternatives, adaptations, and modifications may be made within the spirit and scope of the present invention as set forth in the following claims.

What is claimed is:

1. A coin changer apparatus for coins, comprising:

a) a random access coin storage and dispensing device comprising at least one rotary carousel with a plurality of radially arranged coin stalls formed therein, each coin stall adapted to receive one or more of the coins therein, and at least one drive that engages the carousel so that the carousel rotates when the drive is energized; and b) an electronic controller that is electrically connected to the drive.

2. The coin changer of claim 1, wherein the at least one rotary carousel comprises a main rotary carousel and one or more storage rotary carousels disposed in a staggered, overlapping arrangement.

3. The coin changer of claim 2, further comprising a plurality of transfer mechanisms each having a gate extending into one of the coin stalls of one of the carousels and adapted to move between a normal position and a transfer position that urges the coin in the coin stall to move.

4. The coin changer of claim 3, wherein each transfer mechanism further comprises an actuator coupled directly or indirectly to the gate and electrically connected to the controller.

5. The coin changer of claim 2, further comprising an accept/reject device disposed adjacent to the main carousel, the accept/reject device having an accept gate movable between a coin accept position and a coin reject position, an actuator coupled to the accept gate and electrically connected to the controller, and a guide surface that directs accepted coins into an input slot in the main carousel.

6. The coin changer of claim 2, further comprising a return change delivery device disposed adjacent to the main carousel, the return change delivery device having a return gate movable between a closed position blocking a return slot in the main carousel and an open position not blocking the return slot, and an actuator coupled to the return gate and electrically connected to the controller.

7. The coin changer of claim 2, further comprising a cash box delivery device disposed adjacent to the main carousel, the cash box delivery device having a cash box gate movable between a closed position blocking a cash box slot in the main carousel and an open position not blocking the cash box slot, and an actuator coupled to the cash box gate and electrically connected to the controller.

8. The coin changer of claim 1, wherein the controller tracks the value of the coins stored in each of the coin stalls and determines which coin stalls are to be emptied in order to return a selected amount of change.

9. A coin changer apparatus for coins, comprising:

a) a random access coin storage and dispensing device comprising a main rotary carousel and one or more storage rotary carousels disposed in a staggered, overlapping arrangement, each carousel having a plurality of radially arranged coin stalls formed therein, each coin stall adapted to receive one or more of the coins therein, a plurality of drives each engaging one of the carousels so that the corresponding carousel rotates when the drive is energized, a plurality of transfer mechanisms each having a gate extending into one of the coin stalls of one of the carousels and adapted to move between a normal position and a transfer position that urges the coin in the coin stall to move, and an actuator coupled directly or indirectly to the gate and electrically connected to the controller; and b) an electronic controller that is electrically connected to the drive and that is configured to track the value of the coins stored in each of the coin stalls and to determine which coin stalls are to be emptied in order to return a selected amount of change.

10. The coin changer of claim 9, further comprising an accept/reject device disposed adjacent to the main carousel, the accept/reject device having an accept gate movable between a coin accept position and a coin reject position, an actuator coupled to the accept gate and electrically connected to the controller, and a guide surface that directs accepted coins into an input slot in the main carousel.

11. The coin changer of claim 10, further comprising a coin validator in communication with the accept/reject device and electrically connected to the controller, wherein the coin validator is adapted determine whether the coins are valid, to determine the value of the valid coins, and to communicate the value of the coins to the controller.

12. The coin changer of claim 9, further comprising a return change delivery device disposed adjacent to the main carousel, the return change delivery device having a return gate movable between a closed position blocking a return slot in the main carousel and an open position not blocking the return slot, and an actuator coupled to the return gate and electrically connected to the controller.

13. The coin changer of claim 9, further comprising a cash box delivery device disposed adjacent to the main carousel, the cash box delivery device having a cash box gate movable between a closed position blocking a cash box slot in the main carousel and an open position not blocking the cash box slot, and an actuator coupled to the cash box gate and electrically connected to the controller.

14. The coin changer of claim 9, wherein the carousels overlap so that an open side of each carousel is facing an open side of another carousel.

15. The coin changer of claim 9, further comprising a main frame wherein the carousels, drives, transfer gates, transfer actuators, and controller are mounted directly or indirectly to the main frame.

16. The coin changer of claim 9, further comprising a plurality of sensors disposed on or adjacent to the carousels and electrically connected to the controller.

* * * * *